United States Patent [19]

Bouwkamp et al.

[11] 4,246,876

[45] Jan. 27, 1981

[54] FUEL INJECTION SYSTEM SNUBBER VALVE ASSEMBLY

[75] Inventors: Gerald R. Bouwkamp, West Hartford; Norbert W. Overfield, Bloomfield, both of Conn.

[73] Assignee: Stanadyne, Inc., Windsor, Conn.

[21] Appl. No.: 4,751

[22] Filed: Jan. 19, 1979

[51] Int. Cl.[3] ..... F02M 39/00; F02M 41/08

[52] U.S. Cl. ..... 123/467; 123/457

[58] Field of Search ..... 123/139 DP, 139 AF, 123/139 AK, 139 AT, 139 AL; 137/504, 496, 497

[56] References Cited

U.S. PATENT DOCUMENTS

| | | | |
|---|---|---|---|
| 1,589,515 | 6/1926 | Danielsson | 123/139 DP |
| 2,369,170 | 2/1945 | Motsinger | 137/496 |
| 2,462,189 | 2/1949 | Hess | 137/496 |
| 2,807,279 | 9/1957 | Presnell | 137/504 |
| 3,742,926 | 7/1973 | Kemp | 123/139 AF |
| 3,768,507 | 10/1973 | Dicken | 137/504 |
| 3,780,716 | 12/1973 | Fenne | 123/139 DP |
| 4,161,161 | 7/1979 | Bastenhof | 123/139 DP |
| 4,165,764 | 8/1979 | Grandclement | 137/504 |
| 4,167,168 | 9/1979 | Yamamoto | 123/139 AT |

FOREIGN PATENT DOCUMENTS

| | | | |
|---|---|---|---|
| 797444 | 4/1936 | France | 123/139 DP |

*Primary Examiner*—Charles J. Myhre
*Assistant Examiner*—Carl Stuart Miller
*Attorney, Agent, or Firm*—Prutzman, Kalb, Chilton & Alix

[57] ABSTRACT

A liquid fuel injection system with a snubber valve assembly with a low cost, four-part snubber valve mounted within a valve body and in addition in a second embodiment a low cost, two-part fuel pressurizing valve mounted within the valve body upstream of the snubber valve.

7 Claims, 5 Drawing Figures

FUEL INJECTION SYSTEM SNUBBER VALVE ASSEMBLY

BRIEF SUMMARY OF THE INVENTION

The present invention relates to fuel injection systems of the rotary distributor type used for delivering fuel under high pressure for sequential operation of the fuel injection nozzles of an internal combustion engine for injection of measured charges of fuel into the engine cylinders. More particularly, the present invention relates to a new and improved fuel injection system snubber valve assembly for preventing undesirable secondary nozzle operation and resulting secondary fuel injection immediately after primary fuel charge injection.

In the operation of internal combustion engines where liquid fuel injection is employed, a metered charge of fuel is delivered under high pressure to each engine cylinder nozzle for injection of fuel into the cylinder in synchronism with the engine operating cycle. The nozzle is hydraulically operated by a high pressure pulse of fuel to inject a metered charge into the engine. As the nozzle operating pressure decreases, the nozzle closes and a reverse pressure wave or pulse is thereby generated. Under certain engine operating conditions, for example, during relatively high speed engine acceleration, a reverse pressure wave or pulse of relatively high pressure can be generated which is reflected back downstream to the nozzle by an upstream fuel distributor or delivery valve to form a secondary nozzle operating pulse of sufficient magnitude to cause undesirable secondary fuel injection.

Accordingly, it is a primary object of the present invention to provide a new and improved fuel injection snubber valve assembly for automatically damping reverse pressure waves from the fuel injection nozzle for preventing undesirable secondary fuel injection.

It is another object of the present invention to provide a new and improved fuel injection system snubber valve assembly useful with fuel pumps of the type having a fuel distributor and positive displacement delivery valve upstream of the distributor and wherein the snubber valve assembly has a pressurizing valve operable for preventing fuel cavitation at the delivery valve.

It is a further object of the present invention to provide a new and improved fuel snubber valve assembly for rotary distributor fuel injection pumps of conventional design which permits the pump to be used without undesirable secondary fuel injection.

It is a further object of the present invention to provide a new and improved fuel injection system fuel snubber valve assembly having an economical design which provides a long service free life.

It is a still further object of the present invention to provide a new and improved fuel injection system fuel snubber valve assembly which may be employed with a fuel pump having a rotary distributor and charge measure governing.

Other objects will be in part obvious and in part pointed our more in detail hereinafter.

A better understanding of the invention will be obtained from the following detailed description and the accompanying drawings of illustrative applications of the invention.

DESCRIPTION OF THE PREFERRED EMBODIMENTS

Figure 1:
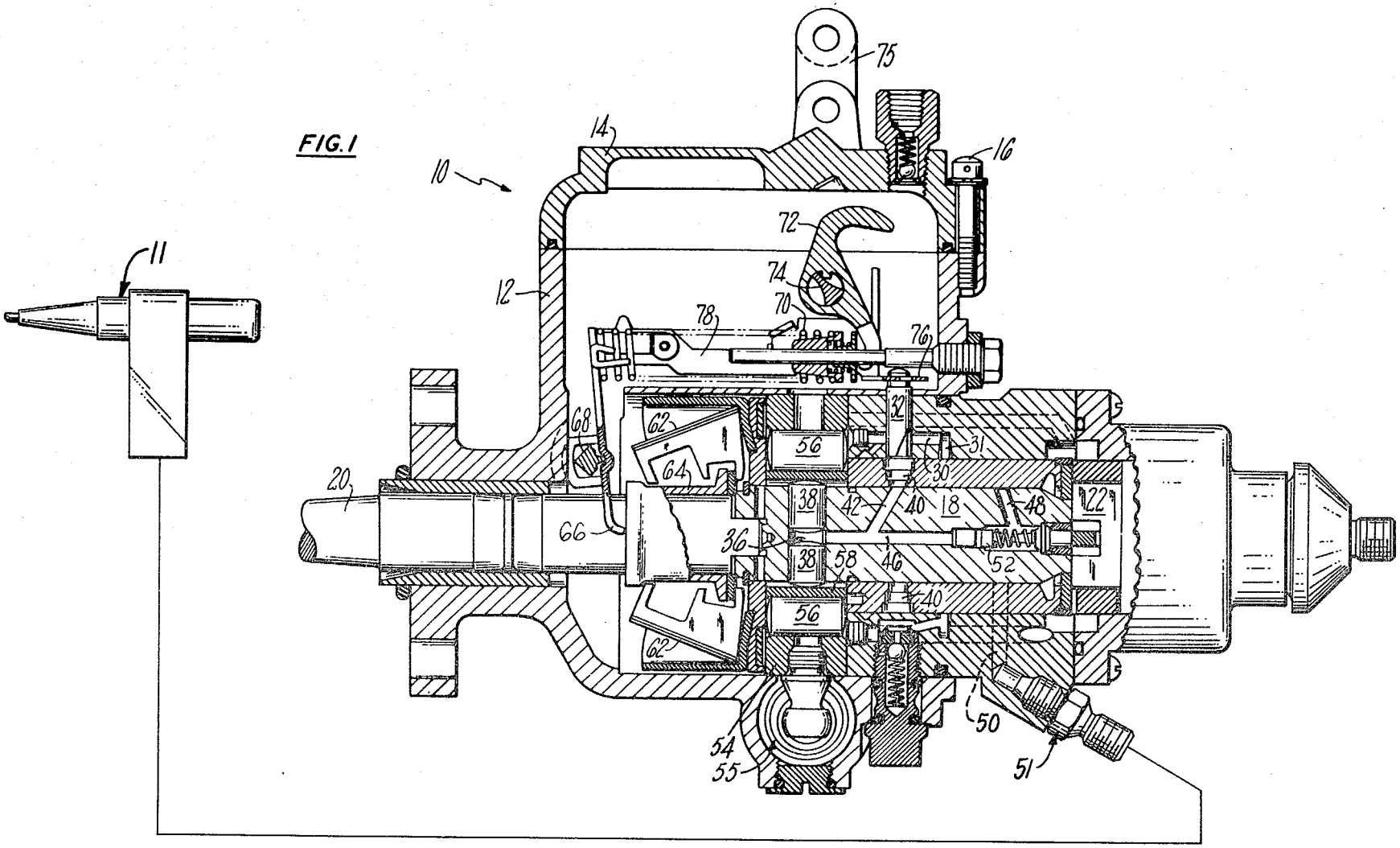
FIG. 1 includes a side elevation section view, partly broken away and partly in section, of a fuel pump having a snubber valve assembly of the present invention and a side view of a fuel injection nozzle connected to the fuel pump.

Referring now to the drawings in detail, a fuel pump 10 is shown in FIG. 1 of the type shown and described in U.S. Pat. No. 3,704,963 of Leonard N. Baxter, dated Dec. 5, 1972, and entitled "Fuel Pump". Briefly, the fuel pump 10 is adapted to supply measured pulses or charges of fuel to the several fuel injection nozzles 11 (only one of which being shown) of an internal combustion engine (not shown). A pump housing 12 having a cover 14 secured by fasteners 16 rotatably supports a pump rotor 18 having a drive shaft 20 with a tapered end for receiving a drive gear, not shown, to which the shaft 20 is keyed.

A vane-type transfer or low pressure supply pump 22 driven by the rotor 18 receives fuel from a reservoir, not shown, and delivers fuel under pressure via an annulus 31 and axial bore 30 to a metering valve 32.

A high pressure charge pump 36 driven by the rotor 18 comprises a pair of opposed plungers 38 reciprocable in a diametral bore of the rotor. The charge pump 36 receives metered fuel from the metering valve 32 through a plurality of angularly spaced radial passages 40 adapted for sequential registration with a diagonal inlet passage 42 of the rotor as the rotor 18 is rotated. Fuel under high pressure is delivered by the charge pump 36 through an axial bore 46 in the rotor 18 to a radial distributor passage 48 adapted for sequential registration with a plurality of angularly spaced distributor outlet passages 50 which communicate with respective individual fuel injection nozzles 11 (only one of which being shown) of the engine via snubber valve assemblies 51 spaced around the periphery of the housing 12. A positive displacement fuel delivery valve piston 52 of a delivery valve is reciprocably mounted in the axial bore 46 and is axially biased to a closed position shown in FIG. 1 by a suitable return compression spring. The delivery valve provides in a conventional manner for achieving a sharp cut-off of fuel to the nozzles and thereby eliminate fuel dribble into the engine combustion chamber after fuel injection. The angularly spaced radial inlet passages 40 to the charge pump 36 and the angularly spaced outlet passages 50 of the rotary distributor are located to provide registration respectively with the diagonal pump inlet passage 42 during the intake stroke of the plungers 38 and with the outlet passage 48 during the compression stroke of the plungers 38.

An annular cam 54 having a plurality of pairs of diametrically opposed camming lobes is provided for actuating the charge pump plungers 38 inwardly together for periodically pressurizing the charge of fuel therein and for thereby periodically delivering pulses of pressurized fuel for injection of fuel charges into the engine cylinders. A pair of rollers 56 and roller shoes 58 are mounted in radial alignment with the plungers 38 by a rotor driven carrier, not shown, for camming the plungers inwardly. For timing the distribution of the pressurized fuel to the fuel nozzles in proper synchronism with the engine operation, the annular cam 54 is adapted to be angularly adjusted by a suitable charge timing mechanism 55.

A plurality of governor weights 62, angularly spaced about the pump shaft 20, provide a variable governing bias on a sleeve 64 which engages a governor plate 66 to urge it clockwise as viewed in FIG. 1 about a support pivot 68. The governor plate 66 is urged in the opposite pivotal direction by a compression spring 70 having a bias which is adjustable by a lever 72 operated by a throttle shaft 74 connected to a throttle arm 75. The governor plate 66 is connected for controlling the angular position of the metering valve 32 by a control arm 76 fixed to the metering valve and by a link 78 pivotally connected to the control arm 76 and normally biased by a tension spring, not shown, into engagement with the governor plate 66.

As is well known, the quantity or measure of the charge of fuel delivered by the charge pump 36 is readily controlled by varying the inlet fuel restriction with the metering valve 32. The pump governor controls the angular position of the metering valve 32 to maintain the engine speed under varying engine load conditions at the speed established by the throttle shaft 74. Rotation of the metering valve 32 under the control of the pump governor varies the metering valve restriction between the passages 30 and 40 and thus varies the fuel delivered by the pump to maintain the associated engine at a speed determined by the setting of the governor.

In accordance with the present invention, the fuel pump snubber valve assembly 51 provides for automatically preventing undesirable secondary fuel injection by damping reverse pressure waves or pulses from the fuel nozzle 11 which occur when the fuel nozzle 11 closes at the end of primary or normal fuel charge injection.

Figures 2, 3, 4, 5:
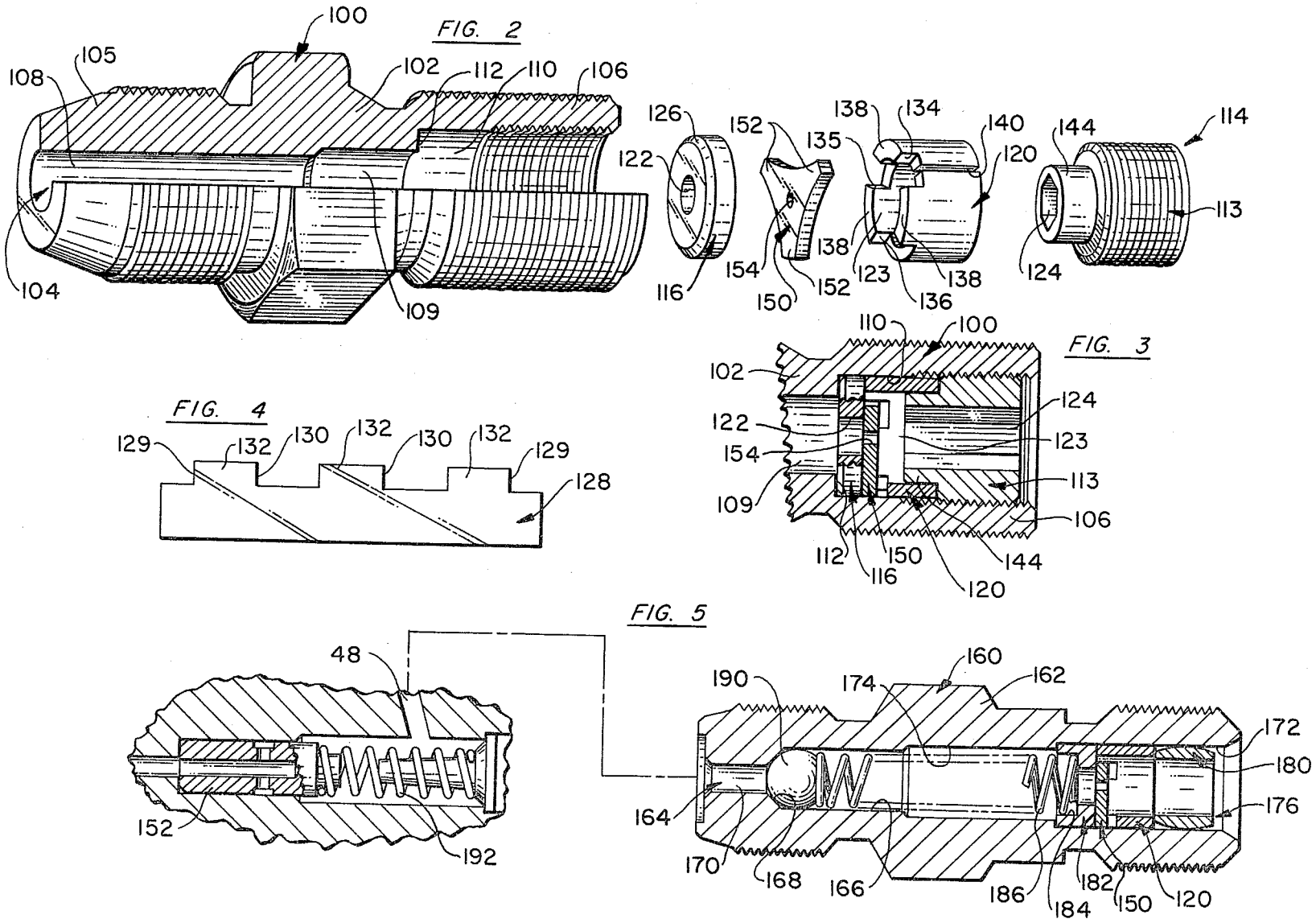
FIG. 2 is an enlarged perspective exploded view, partly broken away and partly in section, showing in detail the several parts of a first embodiment of a snubber valve assembly of the present invention.
FIG. 3 is an enlarged partial longitudinal section view, partly broken away and partly in section, of the snubber valve assembly.
FIG. 4 is a plan view of a stamped plate which is rolled to form a combined spacer and stop sleeve of the snubber valve assembly.
FIG. 5 includes enlarged longitudinal section views, partly broken away and partly in section, of a fuel delivery valve of the fuel pump and a second embodiment of a snubber valve assembly of the present invention.

A first embodiment 100 of a snubber valve assembly incorporating the present invention is shown in detail in FIGS. 2 and 3. The snubber valve assembly 100 comprises as shown in FIG. 2, an elongated valve body 102 having an axially extending bore 104 therethrough and threaded male connector fittings 105, 106 at both longitudinal ends for mounting the valve assembly 100 on the body 12 of the fuel pump 10 as shown in FIG. 1 and for securing a suitable fuel conduit to the snubber valve assembly 100 for connecting the snubber valve assembly to the respective fuel nozzle 11.

The axial bore 104 of the valve body 102 has upstream, intermediate and downstream cylindrical bore sections 108–110 respectively of increasing diameter. An annular radial shoulder 112 is formed between the intermediate and downstream bore sections 109, 110 and the downstream bore section 110 is internally threaded for receiving an externally threaded snubber valve retainer 113.

A snubber valve generally denoted by the numeral 114 is mounted within the downstream bore section 110 for damping the reverse or upstream pressure wave or pulse from the fuel injection nozzle 11 occurring at nozzle closure at the end of fuel injection. In general, the amplitude of the reverse pressure wave or pulse increases with engine speed and with the size of the injected charge and therefore is relatively high during for example, relatively high speed engine acceleration. The snubber valve 114, in damping the reverse or upstream pressure wave, provides for substantially reducing the intensity of any resultant reflected secondary pressure wave or pulse rebounding downstream in the nozzle fuel line normally from the delivery valve or the rotary fuel distributor.

The snubber valve 114 comprises in axially spaced engagement, an upstream circular valve seat plate 116, a snubber valve plate 150, an intermediate combined spacer and valve member stop sleeve 120 and the threaded annular retainer 113. The valve seat 116, intermediate sleeve 120 and retainer 113 have aligned coaxial fuel passageways 122–124 for conducting fuel through the snubber valve 114. The valve seat 116 has a chamfered upstream peripheral circular edge 126 and is held in engagement with the valve body shoulder 112 at the upstream end of the large snubber valve bore section 110. The intermediate sleeve 120 is formed by first stamping an elongated flat plate 128 (shown in FIG. 4) having approximately half-width cut-outs or slots 129 at each end of the plate 128 and intermediate full-width cut-outs or slots 130 and together forming three lands or projections 132 of equal width and spacing. The flat stamped plate 128 is then suitably rolled to form a castellated generally annular sleeve 120 having three equiangularly spaced circumferential slots 134–136 and intermediate axially extending circumferential projections 138 and an axially extending slot 140 at the circumferential ends of the rolled plate. The annular spacer sleeve 120 is rolled to have an outer diameter slightly less than the bore section 110 and so that the sleeve 120 can be readily inserted into the bore 110 with its projections 138 in engagement with the valve seat 116 to hold the valve seat 116 in place against the valve body shoulder 112. Also, the annular spacer sleeve 120 is preferably rolled to be mounted on an inner reduced axial end 144 of the retainer 113 which assists in holding the rolled sleeve 120 in position. The spacer sleeve 120, annular retainer 113 and a snubber valve plate 150 hereinafter described, are preferably installed together in the bore section 110, and the axial passageway 124 in the retainer 113 is shown having a hexagonal cross section to receive a suitable wrench for inserting and removing the retainer 113.

The snubber valve plate 150 is mounted between the valve seat 116 and spacer sleeve 120 and is formed with three equiangularly spaced radial projections 152 for receipt within the three axial slots 134–136 of the spacer sleeve 120. The spacer sleeve slots 134–136 have a constant axial dimension which is slightly greater than the thickness of the valve plate 150 to permit the valve plate 150 to be hydraulically shifted by the fuel between an upstream relatively closed axial position in engagement with the valve seat 116 and a downstream relatively open axial position limited by the slots 134–136. The valve member 150 is contoured to permit relatively free flow of fuel around the plate 150 and through the axial fuel passageway 123 in the intermediate annular sleeve 120 when the valve member 150 is in its downstream open position and whereby the valve plate 150 permits fuel to flow downstream to the fuel injection nozzle without substantial restriction. The valve plate 150 has a central axial snubber port or restriction 154 so that the valve plate 150 in its upstream relatively closed position dampens a reverse pressure wave or pulse from the fuel injection nozzle when it closes. In that regard, the snubber port 154 functions to split or diffuse the reverse pressure wave energy by permitting part of the wave energy to continue upstream, thereby preventing secondary fuel nozzle injection by minimizing the intensity of any resultant reflected secondary pressure wave or pulse. Accordingly, the present invention provides a low cost snubber valve having a valve seat 116, valve member 150 and spacer sleeve 120 adapted to be economically manufactured from flat plates and a retainer 113 adapted to be economically manufactured with a screw machine from commercially available bar stock. The spacer sleeve 120 is economically formed by stamping a slotted plate 128 and then rolling the slotted plate into the annular sleeve 120. Also, the spacer sleeve 120 can be preassembled with the retainer 113, snubber valve plate 150 and valve seat 116 for facilitating snubber valve installation.

A second embodiment 160 of a snubber valve assembly of the present invention shown in FIG. 5 comprises an elongated valve body 162 generally like the valve body 102, but having a different axial bore 164. Specifically, the valve body bore 164 has a cylindrical pressurizing bore section 166 with an upstream generally conical shoulder or seat 168 between that bore section 166 and an upstream reduced bore section 170 which is adapted to be connected as shown in FIG. 5 for receiving fuel from the fuel pump distributor and delivery valve. Also the axial bore 164 comprises a downstream cylindrical snubber valve bore section 172 (which is not internally threaded as in the embodiment of FIGS. 2 and 3) as well as an intermediate cylindrical bore section 174 having a diameter intermediate that of the snubber valve bore section 172 and the pressurizing bore section 166.

A snubber valve 176 mounted in the snubber valve bore section 172 has a snubber valve plate 150 and spacer sleeve 120 preferably formed as described with reference to the embodiment to FIGS. 2 and 3. A press-fit partly spherical annular retainer 180 is shown provided in place of the threaded annular retainer 113. Also, the valve seat plate 182 is made thicker and is formed with an upstream recess 184 for receiving a downstream end of a pressurizing valve compression spring 186.

A spherical ball 190 is formed to be closely received within the cylindrical pressurizing bore section 166 to provide a pressurizing piston for pressurizing the fuel upstream of the piston with the bias of the return spring 186. Accordingly, when the positive displacement or volume retraction fuel delivery valve 152 is returned to its upstream or closed position by its return spring 192 at the end of each fuel charge pulse by the plungers 38 of the charge pump 36, the pressurizing valve provides for reducing or preventing cavitation immediately downstream of the delivery valve piston 152. Such a pressurizing valve is particularly desirable where a snubber valve is employed since the snubber valve restricts the rate of reverse fuel flow to the delivery valve.

The pressurizing valve return spring 186 provides for example, a 250 psi differential fuel pressure across the ball piston 190 with the piston 190 floating at a closed position in the pressurizing cylinder 166 just upstream of an open position in part within the larger intermediate bore section 174 where fuel is permitted to flow around the ball piston 190. The differential or pressurizing pressure is substantially less than the pressure (e.g. of the order of 2500 psi) required for hydraulically operating the fuel injection nozzle 11 and whereby normal fuel injection is not substantially effected by the provision of a pressurizing valve in the nozzle fuel line. Accordingly, the ball piston 190 provides (a) a valve member for permitting substantially normal fuel flow downstream to the fuel injection nozzle and (b) for pressurizing the upstream fuel to the pump delivery valve at the completion of the fuel injection charge pulse from the charge pump. Thus, the embodiment 160 of the snubber valve assembly of the present invention shown in FIG. 5 provides a low cost and reliable combination of pressurizing and snubber valves having parts which can be mass produced and easily assembled.

As will be apparent to persons skilled in the art, various modifications, adaptations and variations of the foregoing specific disclosure can be made without departing from the teachings of the present invention.

We claim:

1. In a liquid fuel injection system for a multiple cylinder internal combustion engine having a fuel injection nozzle for each cylinder adapted to be momentarily opened by a pulse of pressurized fuel for injecting a fuel charge into the cylinder, a positive displacement charge pump for delivering periodic short pulses of pressurized fuel for injection of fuel charges into the engine cylinders in synchronism therewith, a fuel distributor for sequentially conducting the fuel pulses from the charge pump to the fuel injection nozzles, a positive displacement fuel delivery valve intermediate the charge pump and distributor for maintaining a positive residual fuel pressure at each nozzle after injection of fuel thereby, and a fuel snubber valve assembly for each nozzle intermediate the nozzle and distributor for damping a reverse pressure pulse from the nozzle when the nozzle closes at the completion of fuel charge injection thereby, the snubber valve assembly having a valve body with an axial bore with a downstream end connected to the nozzle and an upstream end connected to the fuel distributor, a snubber valve with a snubber valve member axially shiftable in the bore between an upstream relatively closed axial position thereof and a downstream relatively open axial position thereof, and a pressurizing valve in the valve body bore upstream of the snubber valve and having a pressurizing valve member axially shiftable in the bore between an upstream closed axial position thereof and a downstream open axial position thereof and return spring means biasing the pressurizing valve member in the upstream axial direction to its closed position; the improvement wherein the snubber valve comprises in axially spaced engagement within the valve body bore an upstream valve seat with a generally central axial fuel passageway, an intermediate rolled-plate, generally annular and circumferentially discontinuous spacer sleeve and a downstream retainer with a generally central axial fuel passageway and secured within the bore for securing the valve seat and spacer sleeve within the bore, the rolled-plate spacer sleeve having a plurality of angularly spaced and axially extending slots; wherein the snubber valve member is a flat plate and has a generally central axial snubber port and a plurality of angularly spaced radial projections received within the angularly spaced slots to permit the snubber valve member to shift axially between a downstream relatively open limit position established by the slots in the spacer sleeve and an upstream relatively closed axial position in engagement with said valve seat and thereat limit reverse fuel flow with the snubber port; and wherein the pressurizing valve member is a spherical ball piston and the valve body bore has an elongated cylindrical pressurizing bore section closely receiving the ball piston and having a length greater than the diameter of the ball piston for upstream fuel pressurization therewith and by the upstream bias on the piston by the spring means and an enlarged bore section downstream of said cylindrical bore section permitting flow around the ball piston when the ball piston is axially shifted downstream thereto against the bias of the return spring means.

2. In a liquid fuel injection system snubber valve assembly for damping a reverse pressure pulse from a fuel pressure operated fuel injection nozzle when the nozzle closes at the completion of fuel charge injection thereby and having a valve body with an axial bore with a downstream end adapted to be connected to the nozzle and an upstream end adapted to be connected for periodically receiving a pulse of pressurized fuel for opening the nozzle for fuel charge injection, a snubber valve member axially shiftable in the bore between an upstream relatively closed axial position and a downstream relatively open axial position, the improvement wherein the snubber valve assembly comprises in axially spaced engagement within the valve body bore an upstream valve seat with a generally central axial fuel passageway, an intermediate rolled-plate, generally annular and circumferentially discontinuous spacer sleeve and a downstream retainer with a generally central axial fuel passageway and secured within the bore for securing the valve seat and spacer sleeve within the bore, the rolled-plate spacer sleeve having a plurality of angularly spaced axially extending slots; wherein the snubber valve member is a flat plate and has a generally central axial snubber port and a plurality of angularly spaced radial projections received within the angularly spaced slots to permit the snubber valve member to shift axially between a downstream relatively open limit position established by the slots in the spacer sleeve and an upstream relatively closed axial position in engagement with said valve seat and thereat limit reverse fuel flow with the snubber valve port.

3. A liquid fuel injection system snubber valve assembly according to claim 2 wherein the snubber valve assembly further comprises a pressurizing valve in the valve body upstream of the snubber valve and having a spherical ball piston axially shiftable in the bore and return spring means biasing the ball piston in the upstream axial direction, wherein the valve body bore has an elongated cylindrical pressurizing bore section closely receiving the ball piston and having a length greater than the diameter of the ball piston for upstream fuel pressurization therewith and by the upstream bias on the piston by the spring means and an enlarged bore section downstream of said cylindrical bore section and permitting fuel flow around the ball piston when the ball piston is axially shifted downstream thereto against the bias of the return spring means.

4. In a liquid fuel injection system snubber valve assembly for damping a reverse pressure pulse from a fuel pressure operated fuel injection nozzle when the nozzle closes at the completion of a fuel charge injection thereby, the snubber valve assembly having a valve body with an axial bore with a downstream end adapted to be connected to the nozzle and an upstream end adapted to be connected for receiving periodic pulses of pressurized fuel for opening the nozzle for fuel charge injection, a snubber valve member axially shiftable in the bore between an upstream relatively closed axial position and a downstream relatively open axial position and a pressurizing valve in the bore upstream of the snubber valve with a pressurizing valve member axially shiftable in the bore between an upstream closed axial position thereof and a downstream open axial position thereof and return spring means biasing the pressurizing valve member in the upstream axial direction; the improvement wherein the pressurizing valve member is a spherical ball piston, wherein the valve body bore has an elongated cylindrical pressurizing bore section closely receiving for sealing engagement with the ball piston and having a length sufficient to provide an effective ball piston displacement for upstream fuel pressurization to eliminate upstream fuel cavitation therewith and by the upstream bias on the piston by the return spring means and an enlarged bore section downstream of said cylindrical bore section and permitting fuel flow around the ball piston when the ball piston is axially shifted downstream thereto out of sealing engagement with the pressurizing bore section against the bias of the return spray means.

5. In a liquid fuel injection system for a multiple cylinder internal combustion engine having a fuel injection nozzle for each cylinder adapted to be momentarily opened by a pulse of pressurized fuel for injecting a fuel charge into the cylinder, a positive displacement charge pump for delivering periodic short pulses of pressurized fuel for injection of fuel charges into the engine cylinders in synchronism therewith, a fuel distributor for sequentially conducting the fuel pulses from the charge pump to the fuel injection nozzles, and a fuel valve assembly for each nozzle intermediate the nozzle and distributor having a valve body with an axial bore with a downstream end connected to the nozzle and an upstream end connected to the fuel distributor, and a pressurizing valve in the valve body bore with a pressurizing valve member axially shiftable in the bore between an upstream closed axial position thereof and a downstream open axial position thereof and return spring means biasing the pressurizing valve member in the upstream axial direction to its closed position; the improvement wherein the pressurizing valve member is a spherical ball piston and the valve body bore has an elongated cylindrical pressurizing bore section closely receiving for sealing engagement with the ball piston and having a length sufficient to provide an effective ball piston displacement for upstream fuel pressurization to eliminate upstream fuel cavitation therewith and by the upstream bias on the piston by the spring means and an enlarged bore section downstream of said cylindrical bore section permitting flow around the ball piston when the ball piston is axially shifted downstream thereto out of sealing engagement with the pressuring bore section against the bias of the return spring means.

6. A fuel injection system snubber valve assembly according to claim 2, 3, or 4 in combination with a positive displacement fuel delivery valve upstream of the snubber valve assembly, the effective ball piston displacement within the pressurizing bore section being substantially greater than the displacement of the delivery valve for maintaining a positive residual fuel pressure therebetween after fuel charge injection.

7. A fuel injection system according to claim 5 wherein the system comprises a positive displacement fuel delivery valve intermediate the charge pump and distributor, the effective ball piston displacement within the pressurizing bore section being substantially greater than the displacement of the delivery valve for maintaining a positive residual fuel pressure therebetween after fuel charge injection.

* * * * *